US005580058A

United States Patent [19]

Coughlin

[11] Patent Number: 5,580,058

[45] Date of Patent: Dec. 3, 1996

[54] GOLF PUTTER

[75] Inventor: Brian E. Coughlin, 1817 Buckingham Dr. NW. #8, Cedar Rapids, Iowa 52405

[73] Assignee: Brian Edward Coughlin, Waterloo, Iowa

[21] Appl. No.: 478,697

[22] Filed: Jun. 7, 1995

[51] Int. Cl.[6] ..... A63B 53/04

[52] U.S. Cl. ..... 273/250; 473/251; 473/340; 473/341

[58] Field of Search ..... 273/167 R, 77 R, 273/167 D, 167 A, 169, 170, 171, 172, 173, 174, 164.1; 473/251, 340, 341, 250

[56] References Cited

U.S. PATENT DOCUMENTS

| | | | |
|---|---|---|---|
| 3,374,027 | 3/1968 | Jacobs | 273/169 |
| 3,516,674 | 6/1970 | Scarborough | 273/169 |
| 3,666,922 | 2/1975 | Marci | 273/167 F |
| 3,873,094 | 3/1975 | Sebo | 273/169 |
| 3,966,210 | 6/1976 | Rozmus | 273/169 |
| 4,010,958 | 3/1977 | Long | 273/80 C |
| 4,222,566 | 9/1980 | Berry | 273/169 |
| 4,324,404 | 4/1982 | Dian | 273/DIG. 14 |
| 5,176,379 | 1/1993 | Reinberg | 273/168 |
| 5,409,219 | 4/1995 | Saksun | 273/168 |

*Primary Examiner*—Sebastiano Passaniti

[57] ABSTRACT

A golf putter composed of transparent or translucent material with a raised opaque central portion and a clear heel and toe. The width of the central portion approximates the diameter of a golf ball. The distance from the ball striking surface to the heel and toe weights is considerable, it is greater than the radius of a golf ball. The weights are placed far enough behind the ball striking surface to be outside the focused area. When the golfer aligns the putter with the ball, the putter head appears to be a single line with a width approximately equal to the diameter of a golf ball and a depth greater than the radius of a golf ball. The clear heel and toe provide maximum contrast to the central portion, enabling the golfer to maintain focus on the center of the head throughout the stroke. This improves the golfer's ability to visualize the movement of the putter relative to the "target line". Weights are located behind the heel and toe to resist twisting on off-center hits and to add to the total weight of the head. The bottom surface of the head is curved to allow the golfer to tilt the putter, thus customizing the lie angle of the putter.

1 Claim, 5 Drawing Sheets

GOLF PUTTER

BACKGROUND OF THE INVENTION

The present invention pertains to golf putters.

Many golfers imagine a line traveling from the cup through the ball to the putter when they are preparing to putt a golf ball. This is commonly referred to as "lining-up". The line is referred to as a "target line" and it may be straight or curved depending on the curvature of the putting surface. The putter should move along this line and the striking surface of the putter should remain perpendicular to the line during the putting stroke in order to propel the ball along the "target line". The ball should be struck as near to the center of gravity of the head as possible to minimize twisting of the head.

Most putters are constructed of metal and have a striking surface two or three times wider than the diameter of the ball. Markings are often added to the head to assist the golfer in locating the center of gravity of the head. It is difficult to focus on these markings when the putter is in motion. This inhibits the golfer's ability to move the putter along the "target line" and to strike the ball with the center of gravity of the head. It would be desirable to provide a putter that has the twist resistant properties of a heel-toe weighted putter and a center of gravity marked in such a way that the golfer can easily determine the putter's movement relative to the "target line".

SUMMARY OF THE INVENTION

A golf putter composed of transparent or translucent material with an opaque central portion and a clear heel and toe. The width of the central portion approximates the diameter of a golf ball. The clear heel and toe provide maximum contrast to the central portion, enabling the golfer to maintain focus on the center of the head throughout the stroke. This improves the golfer's ability to visualize the movement of the putter relative to the "target line". Weights are located behind the heel and toe to resist twisting on off-center hits and to add to the total weight of the head. The bottom surface of the head is curved to allow the golfer to tilt the putter, thus customizing the lie angle of the putter. The shaft is attached to the center of the head.

A further object of the present invention is to provide a golf putter with weights inserted into cavities behind the heel and toe of the putter head but not extending into the heel and toe. In another embodiment the weights are adhered directly to the back surface of the heel and toe. In both embodiments the weights are positioned perpendicular to the striking surface.

Yet another object of the present invention is to provide a curved bottom allowing the golfer to tilt the putter, thus customizing the lie angle.

In another embodiment, the opaque central portion contains a weight in a cavity extending from the bottom surface toward the top surface.

In another embodiment, the shaft is directed vertically upward from the center of the head and the weights placed behind the heel and toe are sufficient to allow the putter to stand upright while unattended.

BRIEF DESCRIPTION OF THE DRAWINGS

FIG. 1 is a perspective view.

FIG. 2 is a plan view.

FIG. 3 is a front elevation.

FIG. 4 is a plan view showing a centrally located weight.

FIG. 5 is a front elevation.

FIG. 6 is a perspective view.

FIG. 7 is a plan view.

DESCRIPTION OF PREFERRED EMBODIMENTS

Figure 1:
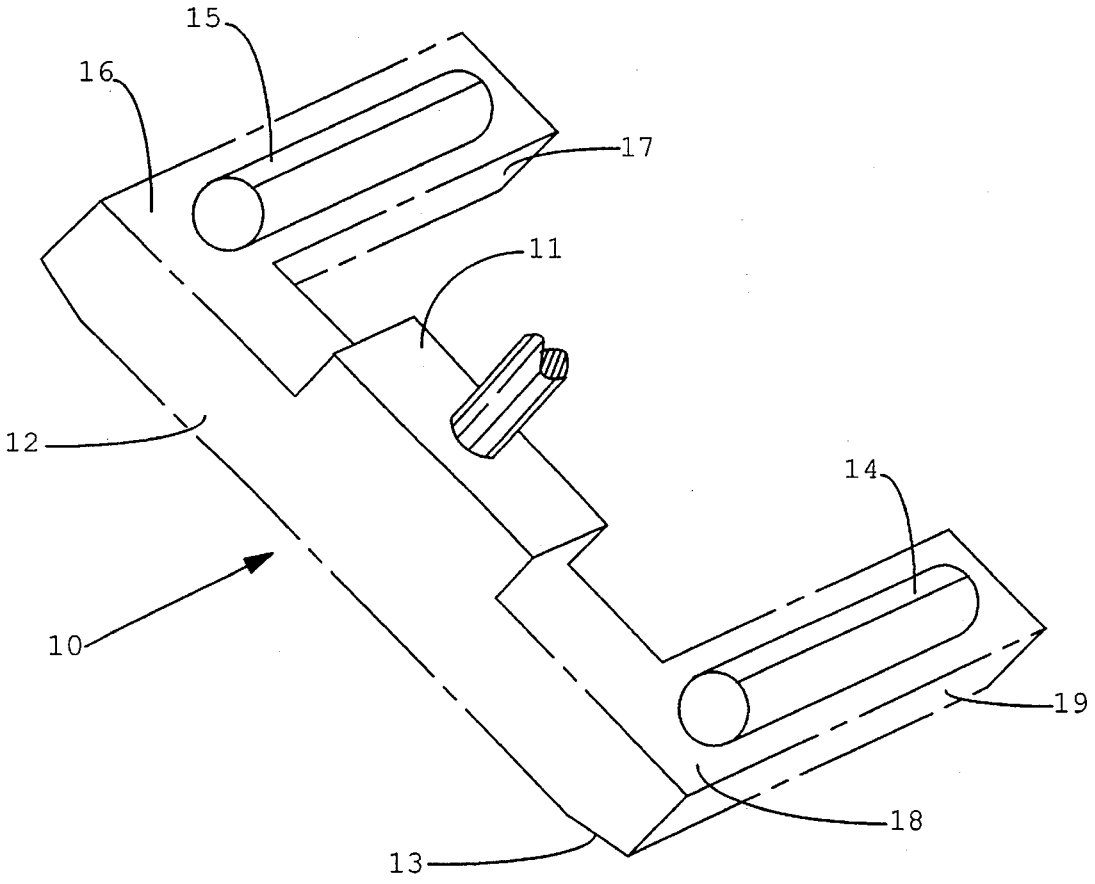
FIGS. 1–3 illustrate a first embodiment of the invention where
Figure 2:
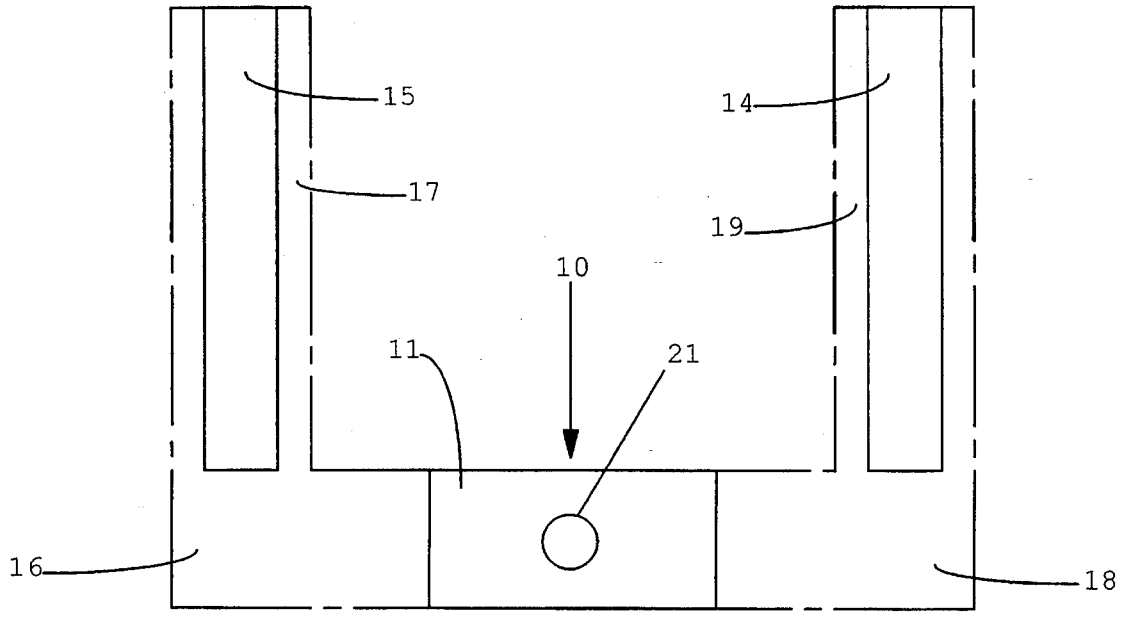
Figure 3:
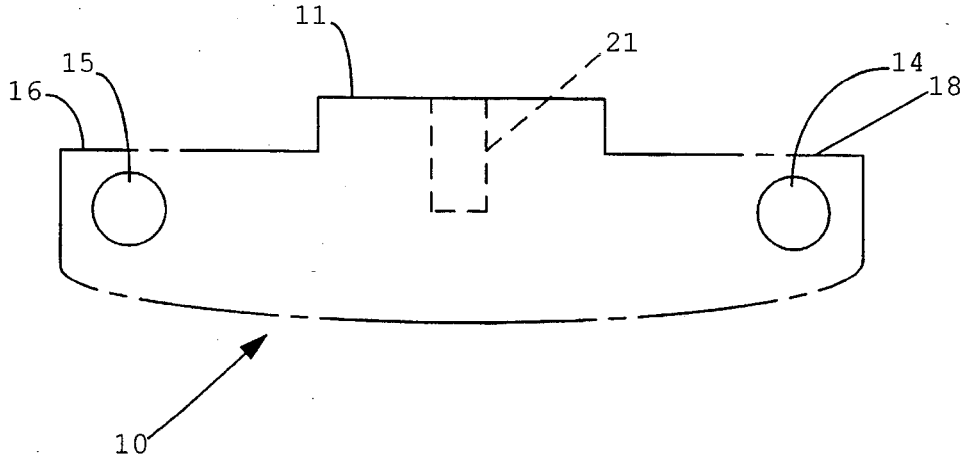

Referring now to the drawings, FIGS. 1–3 illustrate a putter head 10, an opacified top surface 11 with a width approximately equal to the diameter of a golf ball, a ball striking surface 12 with a width greater than the diameter of a golf ball, a rounded bottom surface 13, a heel weight 14, a toe weight 15, a clear toe 16, a toe extension 17, a clear heel 18, a heel extension 19 a shaft 20, and a hole to contain the shaft 21.

The toe extension 17 and heel extension 19 are perpendicular to the ball striking surface 12. They contain cavities into which weights can be inserted. These cavities do not extend into the clear toe 16 or the clear heel 18. The rounded bottom surface allows the golfer to tilt the putter towards the heel or toe without having a sharp edge contacting the ground. The ball striking surface 12 is shown as vertical but it may be inclined at an angle giving the putter different lofts. The depth of the opacified top surface 11 (i.e.: distance from the ball striking surface to the back surface) is approximately equal to the depth of the toe 16 and heel 18. The opacified top surface 11 is raised slightly higher than a plane containing the upper surface of the toe 16 and heel 18 to provide additional contrast, but they may be the same height in another embodiment.

The shape of the heel weight 14 and toe weight 15 is the same as the shape of the cavities into which they are inserted. In FIGS. 1–5, the shape of the heel weight 14 and toe weight 15 and their respective cavities is cylindrical. The putter head 10 may be formed from a light transmitting material such as clear polycarbonate plastic or any suitable plastic material.

Figure 4:
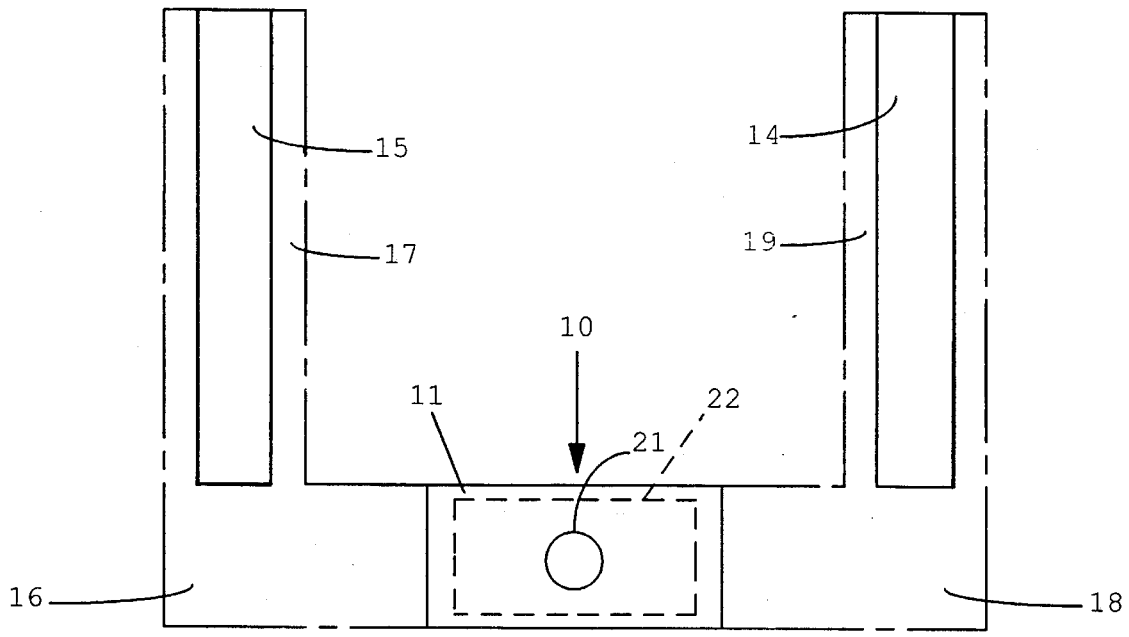
FIGS. 4–5 illustrate a second embodiment of the invention where
Figure 5:
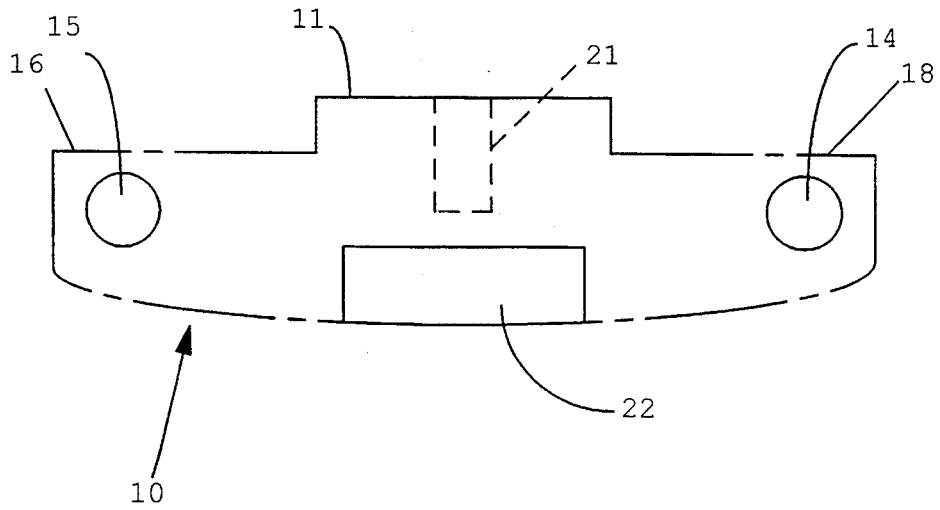

Referring now to FIGS. 4–5, another embodiment of the putter head of FIGS. 1–3 is illustrated with an additional center weight 22. The purpose of center weight 22 is to increase the total weight of the putter head. It is positioned below the opacified surface 11 so that it cannot be viewed by the golfer when putting.

Figure 6:
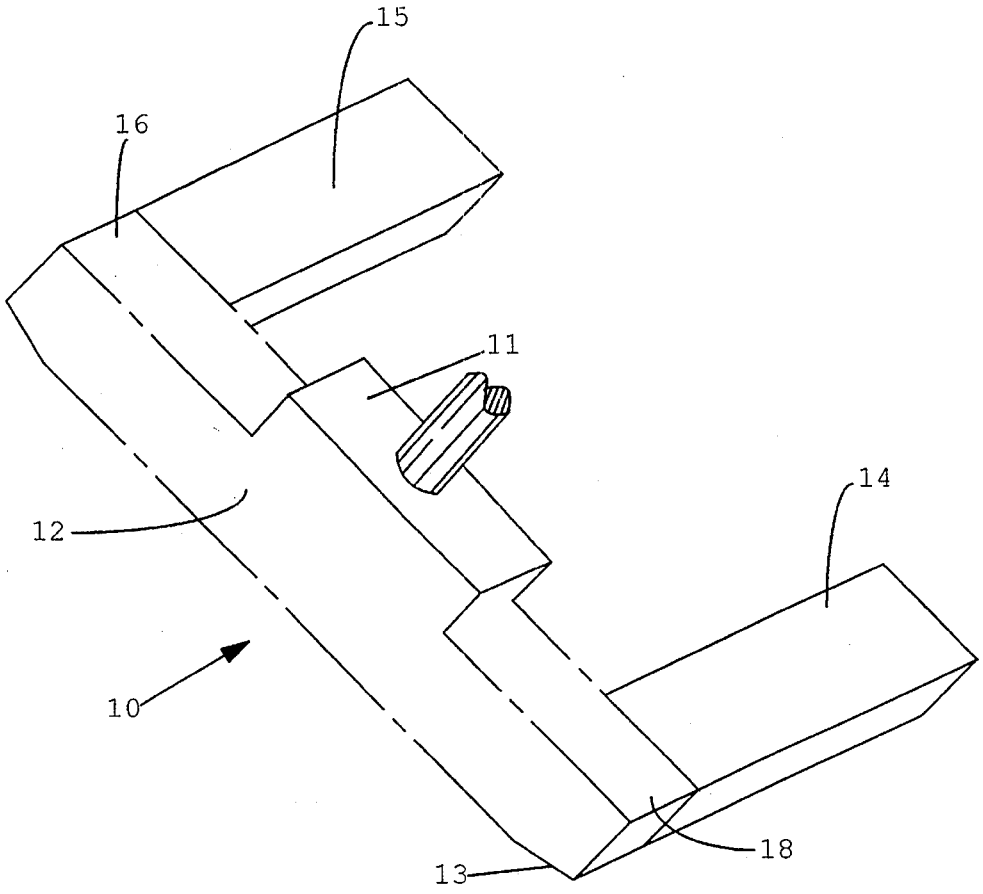
FIGS. 6–7 illustrate a third embodiment of the invention where
Figure 7:
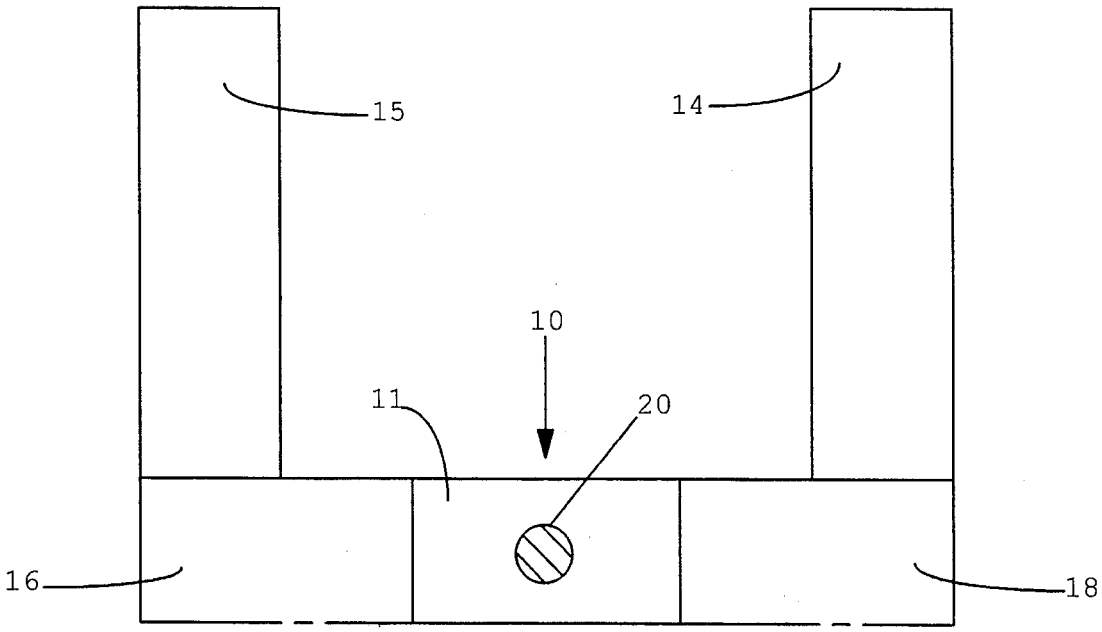

Referring to FIGS. 6–7, a further embodiment of the invention is illustrated with heel weight 14 and toe weight 15 directly attached to the back surface of the heel 18 and toe 16. In this embodiment there is no toe extension 17 or heel extension 19. An adhesive is used to affix the heel weight 14 and toe weight 15 to the back surface of the heel 18 and toe 16.

The heel weight 14, toe weight 15, and center weight 22 are preferably formed from a heavy material such as brass, lead, bronze, steel or any material with a higher density than the light transmitting material of which the putter head 10 is formed.

Figure 8:
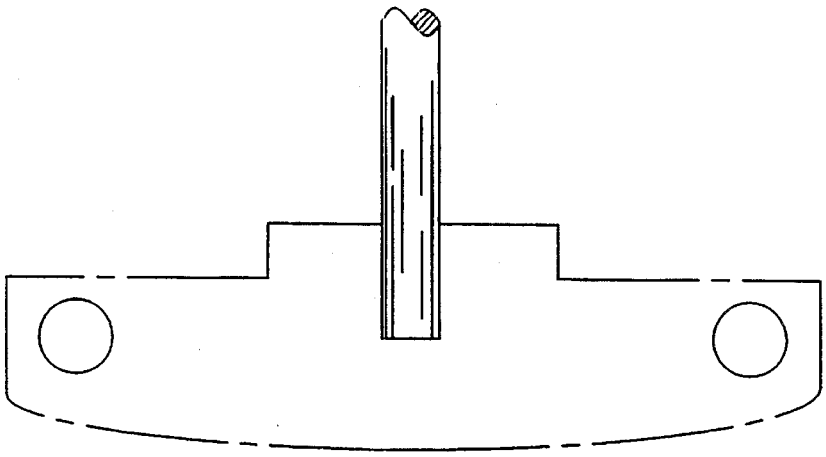
FIGS. 8, 9, and 10 show a variety of shafts attached to the head of the present invention.
Figure 9:
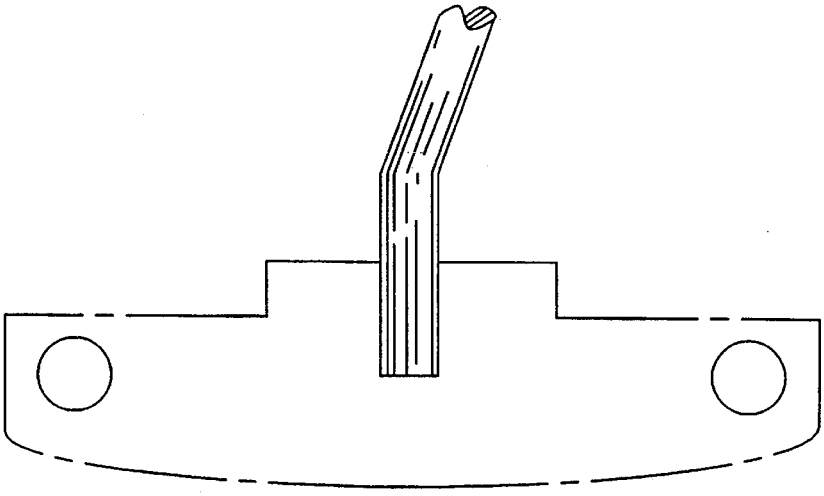
Figure 10:
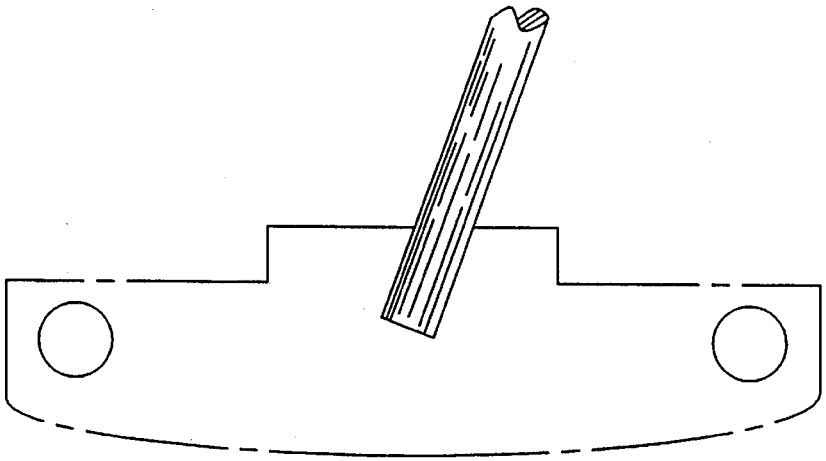

Referring to FIGS. 8–10, three embodiments of the shaft 20 attachment are illustrated. FIG. 8 shows the shaft 20 directed vertically upward enabling the putter to stand upright while unattended. FIG. 9 shows the shaft directed vertically for a small length and then bent towards the golfer providing a lie angle other than vertical. FIG. 10 shows the shaft 20 and the hole which contains the shaft 21 angled towards the golfer.

Although particular embodiments of the invention have been described and illustrated herein, it will be understood that this application is intended to cover all variations, modifications, and adaptations of the invention within the practice of those skilled in the art to which the invention relates without departing from the spirit and scope of the invention and the limits of the appended claims.

I claim:

1. A golf putter having a shaft attached to a head, said head comprising a putter head including a front ball striking surface having a ball striking face thereon, a back surface, a heel, a central portion and a toe; said heel and said toe being fabricated from a light transmitting material with a length from said ball striking surface to said back surface greater than the radius of a USGA golf ball; said central portion including a raised opaque portion having a width approximately equal to the diameter of a USGA golf ball and a length from said ball striking surface to said back surface greater than the radius of a USGA golf ball and a height extending above a plane containing an upper surface of said heel and said toe, whereby said light transmitting material of said toe and said heel provides maximum contrast to the raised opaque central portion to improve a golfer's ability to visualize the movement of the putter head relative to an intended target line; said ball striking face being fabricated from a light transmitting material and extending between a heel end and a toe end; said head including a curved bottom extending from said heel end to said toe end, whereby the putter head may be tilted in order to allow the lie angle of the shaft to be changed; a weight placed behind said heel forming a heel extension perpendicular to the ball striking face; a weight placed behind said toe forming a toe extension perpendicular to the striking face; said weights being fabricated from a material having a density greater than the light transmitting material from which the head is fabricated.

* * * * *